US007114225B2

(12) United States Patent
Casebolt et al.

(10) Patent No.: US 7,114,225 B2
(45) Date of Patent: Oct. 3, 2006

(54) CONNECTOR

(75) Inventors: Scott C. Casebolt, St. Paul Park, MN (US); Bradley A. Rohlf, North St. Paul, MN (US)

(73) Assignee: D B Industries, Inc., Red Wing, MN (US)

( * ) Notice: Subject to any disclaimer, the term of this patent is extended or adjusted under 35 U.S.C. 154(b) by 85 days.

(21) Appl. No.: 10/935,479

(22) Filed: Sep. 7, 2004

(65) Prior Publication Data

US 2006/0048351 A1 Mar. 9, 2006

(51) Int. Cl.
*A44B 11/25* (2006.01)

(52) U.S. Cl. ..... 24/634; 24/669; 24/701; 24/265 BC

(58) Field of Classification Search ..... 24/634, 24/669, 702, 701, 703
See application file for complete search history.

(56) References Cited

U.S. PATENT DOCUMENTS

| | | | | |
|---|---|---|---|---|
| 1,459,674 | A | 6/1923 | Jabner | |
| 2,518,889 | A | 8/1950 | Henderson | |
| 2,847,748 | A | 8/1958 | Robinton | |
| 3,090,092 | A | 5/1963 | Szemplak et al. | |
| 3,168,770 | A | 2/1965 | John, Jr. et al. | |
| 3,201,840 | A | 8/1965 | Jantzen | |
| 3,513,510 | A * | 5/1970 | Copes | 24/323 |
| 3,789,467 | A | 2/1974 | Aratani et al. | |
| 4,101,171 | A | 7/1978 | Sasaki et al. | |
| 4,307,494 | A | 12/1981 | Gasse et al. | |
| 4,321,734 | A | 3/1982 | Gandelman | |
| 4,534,087 | A | 8/1985 | Lau | |
| 4,587,695 | A | 5/1986 | Jensen | |
| 5,033,171 | A | 7/1991 | Kasai | |
| 5,347,693 | A * | 9/1994 | Otrusina | 24/573.11 |
| 5,419,020 | A | 5/1995 | Murai | |
| 5,561,891 | A | 10/1996 | Hsieh | |
| 5,857,247 | A | 1/1999 | Warrick et al. | |
| 5,926,928 | A | 7/1999 | Lundstedt | |
| 5,974,637 | A | 11/1999 | Tracy et al. | |
| 6,343,824 | B1 | 2/2002 | Foy | |

(Continued)

FOREIGN PATENT DOCUMENTS

DE 19 27 100 A1 12/1970

(Continued)

OTHER PUBLICATIONS

Photo 1, Front assembled view of "RADIUS" buckle; in public use at least as early as Sep. 2001.

(Continued)

*Primary Examiner*—Katherine Mitchell
*Assistant Examiner*—Marcus Menezes
(74) *Attorney, Agent, or Firm*—IPLM Group, P.A.

(57) ABSTRACT

A preferred embodiment connector includes a catch, a housing, and a locking member. The catch has an end with an engaging member, and the housing has a cavity and a supporting member. The locking member is positioned within the cavity and has a first position and a second position. The cavity and the locking member have a first configuration when the locking member is in the first position, and the cavity and the locking member have a second configuration when the locking member is in the second position. The first configuration is configured and arranged to receive the end of the catch. The second configuration is configured and arranged to engage the end of the catch between the supporting member and the locking member thereby locking the catch, and the supporting member of the housing provides a surface upon which the engaging member exerts force should a fall occur.

28 Claims, 11 Drawing Sheets

U.S. PATENT DOCUMENTS

| | | | | |
|---|---|---|---|---|
| 6,357,092 | B1 * | 3/2002 | Burrows | 24/644 |
| 6,668,434 | B1 * | 12/2003 | Casebolt et al. | 24/634 |
| 6,824,028 | B1 * | 11/2004 | Mutai et al. | 224/271 |

FOREIGN PATENT DOCUMENTS

GB 2189540 A * 10/1987

OTHER PUBLICATIONS

Photo 2, Front perspective disassembled view of "RADIUS" buckle; in public use at least as early as Sep. 2004.

Photo 3, Front perspective disassembled view of "RADIUS" buckle; in public use at least as early as Sep. 2004.

Photo 4, Front partially assembled view of "RADIUS" buckle with the male portion inserted into the female portion; in public use at least as early as Sep. 2004.

Photo 5, Front partially assembled view of "RADIUS" buckle with the male portion inserted into the female portion with the male portion compressing the spring of the female portion; in public use at least as early as Sep. 2004.

Photo 6, Side view of the male portion of "RADIUS" buckle; in public use at least as early as Sep. 2004.

Photo 7, Front perspective view of the female portion of "RADIUS" buckle; in public use at least as early as Sep. 2004.

Photo 8, Front perspective view of the female portion of "RADIUS" buckle; in public use at least as early as Sep. 2004.

Photo 9, Top view of the female portion of "RADIUS" buckle; in public use at least as early as Sep. 2004.

* cited by examiner 101
115
121
135
102

135

115
116
117
118

115

132
134
133

131

102
109
106
107
108
104

121
123
124
127
122

102
110
105

121
123
122
124
127

122
126
121
125

102
106a
106
107
109
108
103

FIG. 22
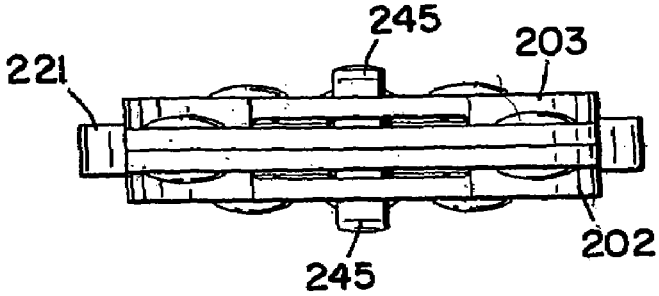
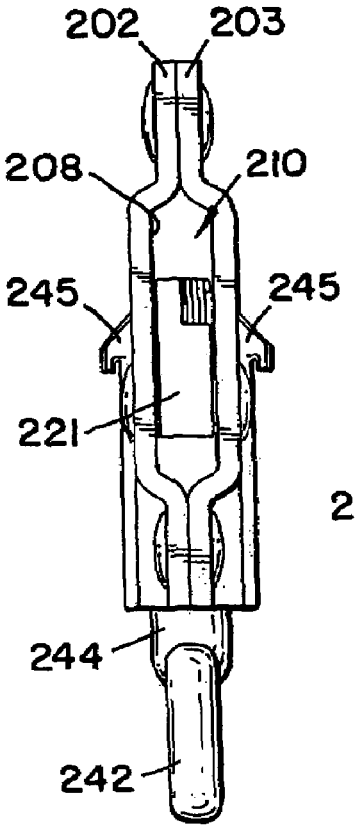
FIG. 23
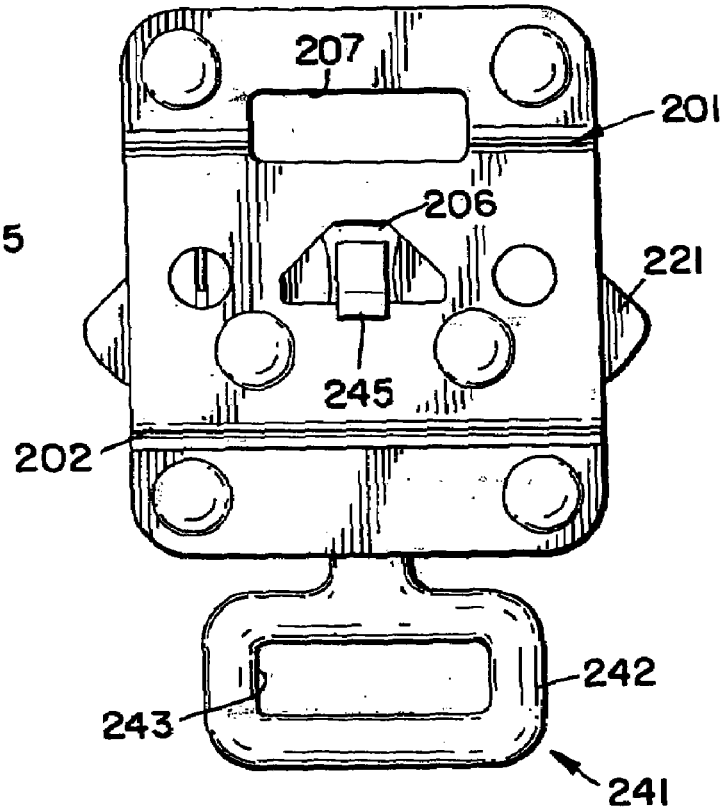
FIG. 21
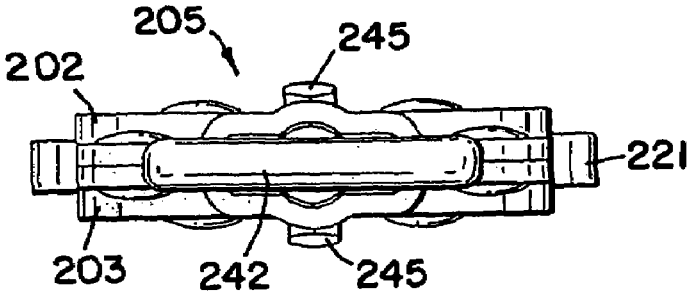
FIG. 24

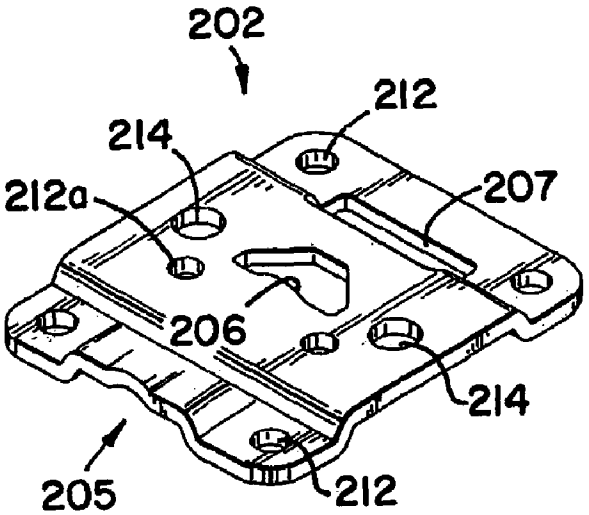
FIG.29
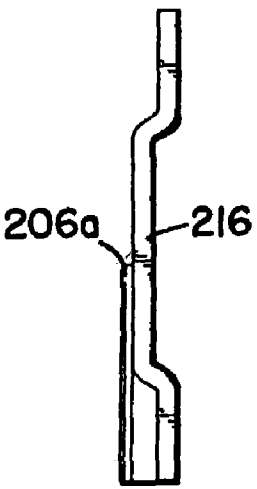
FIG.31
FIG.30
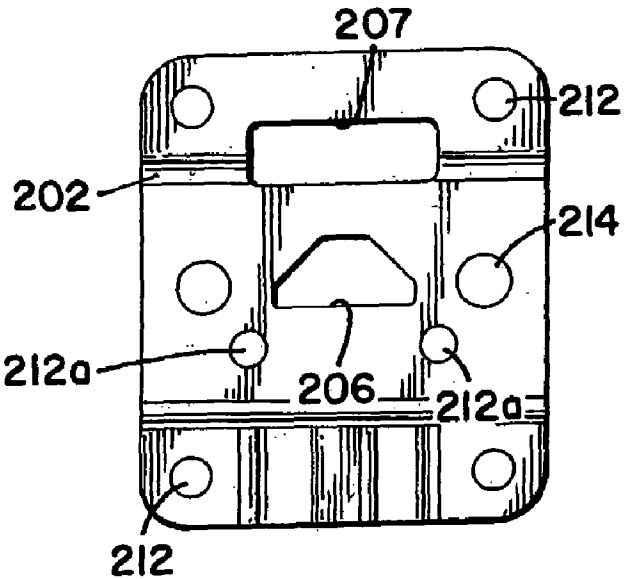
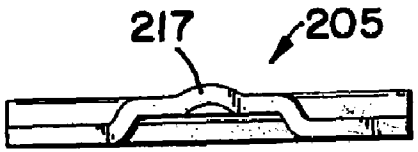
FIG.32

FIG. 38
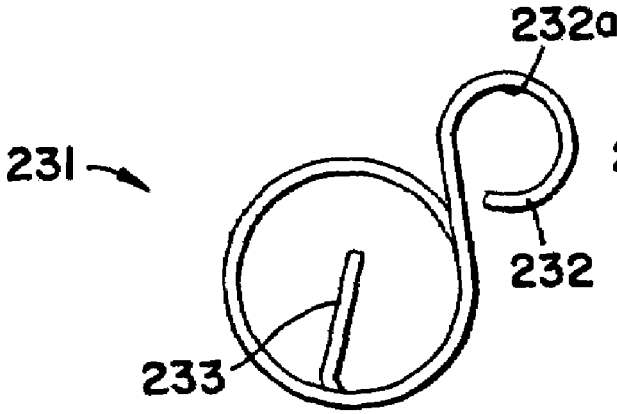
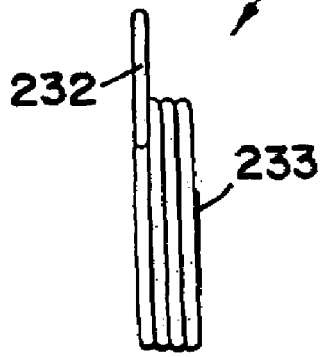
FIG. 39
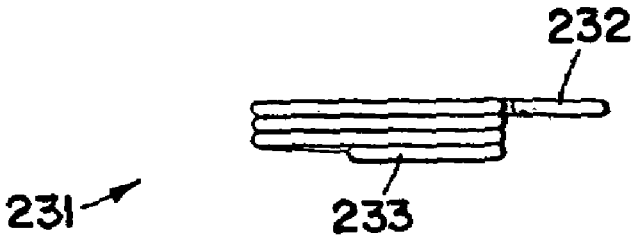
FIG. 40

CONNECTOR

BACKGROUND OF THE INVENTION

1. Field of the Invention

The present invention relates to a connector, and more particularly, to a connector for use with fall protection assemblies.

2. Description of the Prior Art

Various occupations place people in precarious positions at relatively dangerous heights thereby creating a need for fall protection assemblies. Among other things, such assemblies usually include at least one connecting device interconnected between a support structure and a person working in proximity to the support structure. The connecting device includes a connecting element, which is typically connected to a connecting member of a safety harness worn by the user. Obviously, it is important to properly connect the connecting device to the safety harness.

One problem is that it may be difficult to determine which connecting device may be properly connected to which connecting member on the safety harness. Safety harnesses typically include several connecting members for various purposes, such as fall arrest, work positioning, restraint, suspension, rescue, riding, climbing, and connecting tools and other accessories. Although some connecting devices may be properly connected to more than one connecting member on the safety harness, which depends upon the task to be performed by the user, it may be improper to connect the connecting devices to some of the connecting members. There has been no simple way to communicate to the user the purposes of the various connecting members and the connecting devices, and this may be compounded by the complexity of the particular safety harness style, the frequency of use of the safety harness, and the possible language barriers. Therefore, there is a need for a more user-friendly way to determine the proper connections to the safety harness.

SUMMARY OF THE INVENTION

A preferred embodiment connector for use with a fall protection assembly includes a catch, a housing, and a locking member. The catch has an end with an engaging member, and the housing has a cavity and a supporting member. The locking member is positioned within the cavity and has a first position and a second position. The cavity and the locking member have a first configuration when the locking member is in the first position, and the cavity and the locking member have a second configuration when the locking member is in the second position. The first configuration is configured and arranged to receive the end of the catch, and the second configuration is configured and arranged to engage the end of the catch thereby locking the catch. The end is engaged in the second configuration between the supporting member and the locking member, and the supporting member of the housing provides a surface upon which the engaging member exerts force should a fall occur.

Another preferred embodiment connector for use with a fall protection assembly includes a catch, a housing, and first and second pawls. The catch has an end with an engaging member, and the housing has a cavity and a supporting member. The first and second pawls are pivotally mounted within the cavity of the housing and have a first position and a second position. The cavity and the pawls have a first configuration when the pawls are in the first position, and the cavity and the pawls have a second configuration when the pawls are in the second position. The first configuration is configured and arranged to receive the end of the catch, and the second configuration is configured and arranged to engage the end of the catch thereby locking the catch. The end is engaged in the second configuration between the supporting member and the pawls, and the supporting member of the housing provides a surface upon which the engaging member exerts force should a fall occur.

Another preferred embodiment connector for use with a fall protection assembly includes a housing, opposing first and second pawls, first and second springs, and a catch. The housing has a cavity and a supporting member. The opposing first and second pawls are pivotally mounted within the cavity of the housing, and the pawls have respective latching portions extending toward one another and force receiving portions projecting outward beyond a perimeter defined by the housing and extending away from one another. The first and second springs are interconnected between the housing and respective pawls in a manner that biases the latching portions of the pawls to pivot toward one another in a first position. The catch has an end sized and configured for insertion between the pawls and engagement between the latching portions in such a manner that the force receiving portions must be moved in a direction toward the housing in a second position to release the end from between the pawls. The end is engaged in the second position between the supporting member and the pawls, and the supporting member of the housing provides a surface upon which the end exerts force should a fall occur.

BRIEF DESCRIPTION OF THE DRAWINGS

FIG. 21 is a front view of the connector shown in FIG. 20;

FIG. 22 is a top view of the connector shown in FIG. 21;

FIG. 23 is a left side view of the connector shown in FIG. 21;

FIG. 24 is a bottom view of the connector shown in FIG. 21;

FIG. 29 is a front perspective view of an outer plate of the housing shown in FIG. 25;

FIG. 30 is a front view of the outer plate shown in FIG. 29;

FIG. 31 is a right side view of the outer plate shown in FIG. 30;

FIG. 32 is a bottom view of the outer plate shown in FIG. 30;

FIG. 38 is a front view of a spring of the connector shown in FIG. 20;

FIG. 39 is a right side view of the spring shown in FIG. 38;

FIG. 40 is a bottom view of the spring shown in FIG. 38;

DETAILED DESCRIPTION OF A PREFERRED EMBODIMENT

Figure 1:
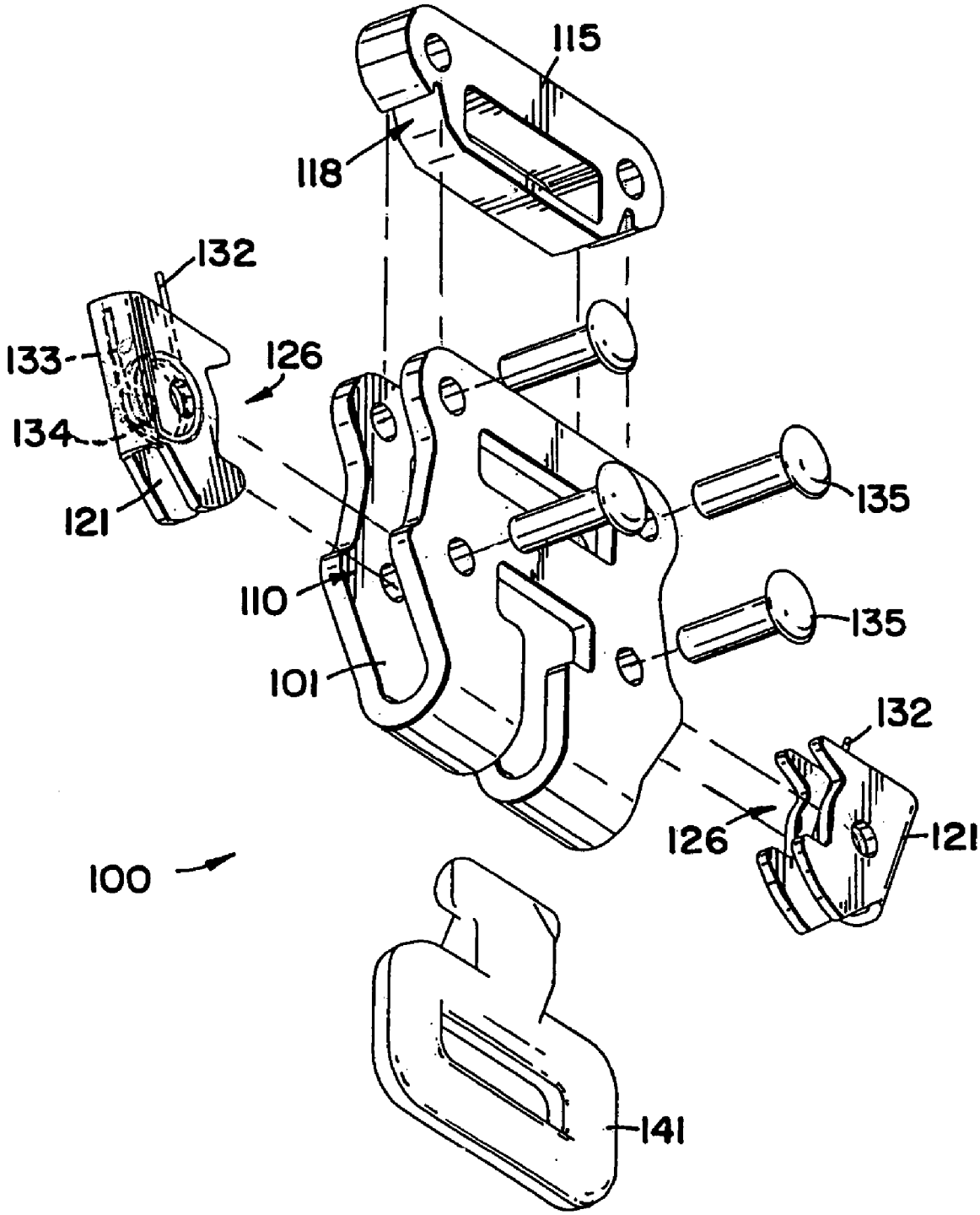
FIG. 1 is a front exploded perspective view of a connector constructed according to the principles of the present invention.

A preferred embodiment connector constructed according to the principles of the present invention is designated by the numerals 100 and 200 in the drawings.

The connectors 100 and 200 generally include a female portion or housing and a male portion or catch. Although preferably used to interconnect a safety harness and a lanyard as an external connection to the safety harness, it is also recognized that the connector may be used to interconnect straps of a safety harness as an internal connection of the safety harness. Preferably, the shoulder straps of the safety harness are secured to the housing in a manner already known in the art, and a lanyard is secured to the catch in a manner already known in the art. The catch is releasably latched to the housing in order to releasably connect the lanyard and the safety harness to one another.

The connector 100 includes a housing 101 and a catch 141 as shown in FIG. 1. With reference to FIGS. 2–7, the housing 101 includes an outer plate 102 and an inner plate 115. The outer plate 102 is preferably a U-shaped plate having a first side 103, a second side 104, and a bottom 105 interconnecting the first side 103 and the second side 104. The first and second sides 103 and 104 and the bottom 105 define a cavity 110. The inner plate 115 is preferably sandwiched between the first and second sides 103 and 104 within the cavity 110 proximate the top of the outer plate 102. The outer plate 102 is preferably made of steel, and the inner plate 115 is preferably made of nylon plastic.

The outer plate 102 includes a slot 106 extending from the bottom 105 upward through the first and second sides 103 and 104 toward the middle of the outer plate 102. The first side 103 includes a lock-out portion 106*a*, which is in communication with the slot 106 and is preferably a slot extending perpendicular from the top of the slot 106. The slot 106 and the lock-out portion 106*a* form a T-shaped opening on the first side 103 of the outer plate 102. A slot 107 of the outer plate 102 aligns with a slot 116 of the inner plate 115, which are above the slot 106 proximate the top of the housing 101. The slots 107 and 116 are configured and arranged to receive the shoulder straps of the safety harness as is known in the art.

Figures 2, 3, 4, 5, 6, 7, 8, 9, 10, 11, 12, 13:
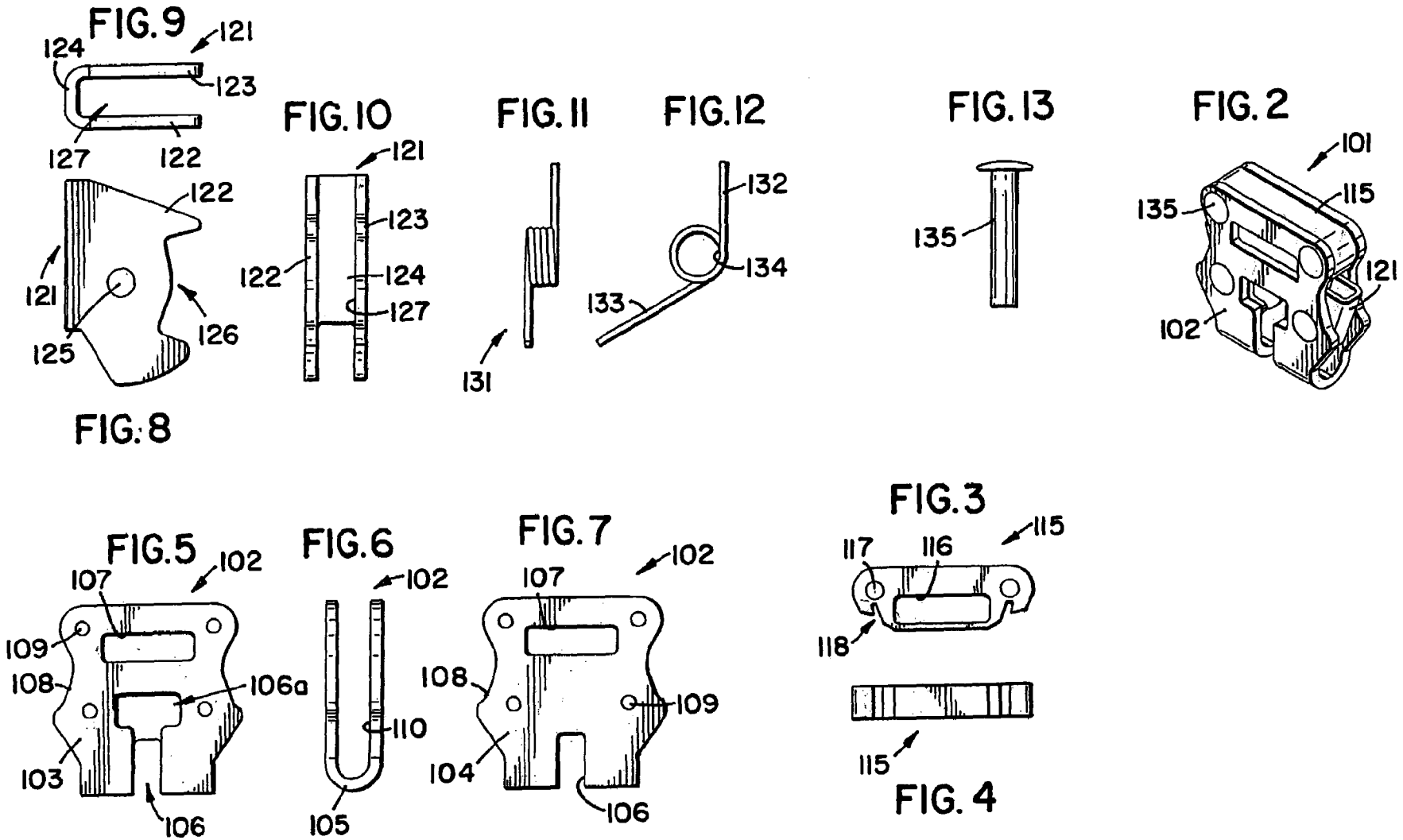
FIG. 2 is a front perspective view of a housing of the connector shown in FIG. 1.
FIG. 3 is a front view of an inner plate of the housing shown in FIG. 2.
FIG. 4 is a bottom view of the inner plate shown in FIG. 3.
FIG. 5 is a front view of an outer plate of the housing shown in FIG. 2.
FIG. 6 is a right side view of the outer plate shown in FIG. 5.
FIG. 7 is a back view of the outer plate shown in FIG. 5.
FIG. 8 is a front view of a pawl of the connector shown in FIG. 1.
FIG. 9 is a top view of the pawl shown in FIG. 8.
FIG. 10 is a right side view of the pawl shown in FIG. 8.
FIG. 11 is a left side view of a spring of the connector shown in FIG. 1.
FIG. 12 is a front view of the spring shown in FIG. 11.
FIG. 13 is a side view of a rivet of the connector shown in FIG. 1.
Figure 18:
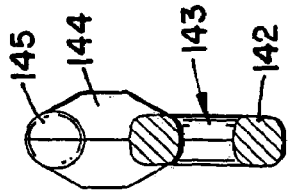
FIG. 18 is a right side partial cross section view of the catch shown in FIG. 15.
Figure 16:
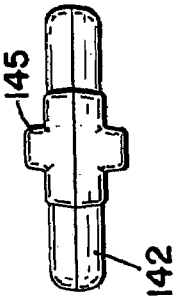
FIG. 16 is a top view of the catch shown in FIG. 15.
Figure 15:
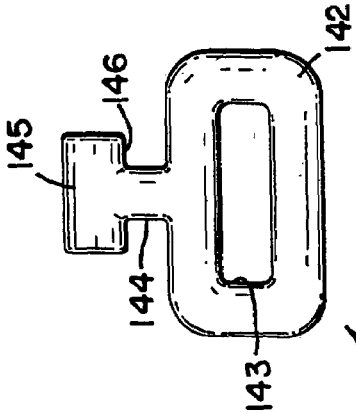
FIG. 15 is a front view of the catch shown in FIG. 14.
Figure 19:
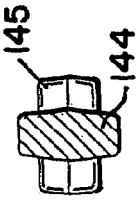
FIG. 19 is a bottom partial cross section view of the catch shown in FIG. 15.
Figure 17:
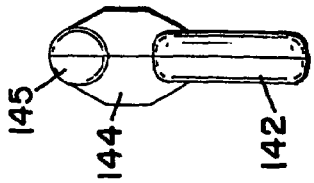
FIG. 17 is a left side view of the catch shown in FIG. 15.
Figure 14:
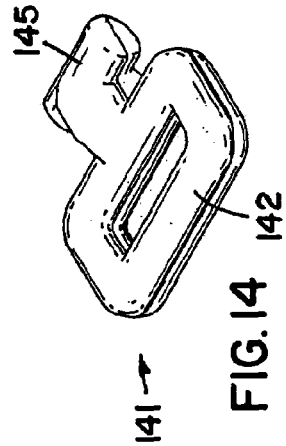
FIG. 14 is a front perspective view of a catch of the connector shown in FIG. 1.

The outer plate 102 also includes four apertures 109 extending through the first and second sides 103 and 104. Two apertures 109 are positioned at the top of the housing 101, one on each side of the top of the slot 107. The other two apertures 109 are positioned proximate the middle of the housing 101, one on each side of the lock-out portion 106*a*. The top two apertures 109 correspond with apertures 117 in the inner plate 115. A rivet 135, as shown in FIG. 13, extends through each aperture 109 in the first side 103, through each aperture 117 in the inner plate 115, and then through each aperture 109 in the second side 104 at the top of the housing 101 to operatively connect the inner plate 115 to the outer plate 102.

The first and second sides 103 and 104 also include notches 108 on each side extending between the slots 106 and 107. The notches 108 allow for pawls 121 to extend outward from the cavity 110 of the housing 101. The pawls 121 are preferably made of steel and sized to be thinner than the inner plate 115. With reference to FIGS. 8–10, the pawls 121 are preferably identical and positioned as mirror images to one another. Each pawl 121 is preferably U-shaped and includes a first side 122, a second side 123, and a third side 124 interconnecting the first and second sides 122 and 123. The sides 122, 123, and 124 define a cavity 127. The first and second sides 122 and 123 include an aperture 125 proximate the middle of the pawl 121 and an opening 126 on the side opposite the third side 124. The opening 126 is configured and arranged to accept the end 145 of the catch 141.

The inner plate 115 also has opposing slots 118 that are sized and configured to accommodate first ends 132 of respective springs 131 between the first and second sides 103 and 104. The slots 118 are preferably positioned on each side of the slot 116 and below each aperture 117 proximate the bottom and the sides of the inner plate 115. With reference to FIG. 11–12, the springs 131 are preferably helical coils with the first ends 132 extending outward at one end and the second ends 133 extending outward at the other end, as shown in FIG. 11, approximately 120 degrees from the first ends 132, as shown in FIG. 12. The coiled portions of the springs 131 form apertures 134, with the ends 132 and 133 extending outward therefrom.

The ends 132 of the springs 131 are positioned within respective slots 118 of the inner plate 115, the apertures 134 align with apertures 109 of the outer plate 102 and apertures 125 of the pawls, and the second ends 133 are positioned along the third sides 124 of the pawls. The springs 131 are placed within the cavities 127 of the pawls 121. A rivet 135 extends though each aperture 109 in the first side 103, through each aperture 125 in one side of the pawls 121, through each aperture 134 in the springs, through each aperture 125 in the other side of the pawls 121, and then through each aperture 109 in the second side 104 proximate the middle of the housing 101 to operatively connect the pawls 121 and the springs 131 within the cavity 110 proximate the middle of the housing 101. As a result, the pawls 121 are pivotally mounted between the first and second sides 103 and 104. The pawls 121 have respective latching portions that are biased toward one another by respective springs 131. This inward pivoting of the pawls 121 is limited by contact between the pawls 121 and respective slots 118 of the inner plate 115. The pawls 121 also have respective force receiving portions that project away from one another and outward beyond the perimeter of the outer plate 102. These force receiving portions or "wings" define bearing surfaces that face away from the catch 141 and in divergent fashion relative to one another.

Each pawl 121 is pivotable about a pivot point, the rivet 135 through the aperture 125, between a first position and a second position. The pawls 121 and the cavity 110 define a first configuration when the pawls 121 are in the first position, and the pawls 121 and the cavity 110 define a second position when the pawls are in the second position. In the first position, the latching portions of the pawls 121 are pivoted outward away from one another and the force receiving portions of the pawls 121 are pivoted inward toward one another. The latching portions of the pawls 121 are pivoted outward to create a larger opening within the cavity 110 proximate the slot 106 thereby defining the first configuration, which is configured and arranged to receive the end 145 of the catch 141 and allow the end 145 to be slid within the cavity 110 along the slot 106. In the second position, the latching portions of the pawls 121 are pivoted inward toward one another and the force receiving portions of the pawls 121 are pivoted outward away from one another. The latching portions of the pawls 121 are pivoted inward to create a smaller opening within the cavity proximate the slot 106 thereby defining the second configuration, which is configured and arranged to engage the end 145 of the catch 141 between the bottom 105 and the pawls 121 thereby locking the catch 141. In other words, the first configuration allows the catch 141 to be slid along the slot 106, and the second configuration does not allow the catch 141 to be slid along the slot 106.

With reference to FIGS. 14–19, the catch 141 is preferably a key-like member including a strap engaging end 142 and a lead end 145. The strap engaging end 142 includes a slot 143 through which the strap of a lanyard may be inserted and operatively connected to the catch 141 as is well known in the art. An intermediate member 144 interconnects the strap engaging end 142 and the end 145 and is narrower than the slot 106 of the housing 101. Preferably, the intermediate member 144 has an elongated shape as shown in the cross section in FIG. 19 to prevent the catch 141 from rotating freely within the housing 101 thereby preventing the catch 141 from becoming disconnected from the housing 101 should one or both of the pawls 121 unlock the catch 141. The end 145 is preferably a bar member extending outward from the intermediate member 144 and includes recessed edges 146 proximate the intermediate member 144. The end 145 may be any suitable shape as long as it is capable of being inserted into the lock-out portion 106*a* of the housing 101. The end 145 preferably has rounded edges so as to allow for the end 142 to pivot within the cavity 110 proximate the bottom 105, the edges of which are also preferably rounded to facilitate the pivoting.

In operation, the housing 101 has a "receiving" end defined by the slot 106 and the lock-out portion 106*a* that is sized and configured to receive the lead end 145 of the catch 141. More specifically, the lead end 145 of the catch 141 may be described as generally T-shaped, with recessed edges or shoulders 146 on opposite sides of the intermediate member 144. As the end 145 is inserted into the lock-out portion 106*a* within the cavity 110 between the notches 126 of the pawls 121 and the catch 141 is slid downward with the intermediate member 144 within the slot 106 of the housing 101, the end 145 pushes the latching portions of the pawls 121 outward away from one another. Upon continued sliding of the catch 141, the end 145 slides past the pawls 121 and the pawls 121 snap back toward one another thereby locking the end 145 between the pawls 121 and the bottom 105 of the housing 101. The pawls 121 act as locking members locking the end 145 between the pawls and the bottom 105 of the housing 101. Should a fall occur, the bottom 105 acts as a supporting member for the recessed edges 146 of the end 145 and the end 145 acts as an engaging member engaging the supporting member and applying force thereto.

The lock-out portion 106*a* may be any suitable shape as long as it corresponds with the shape of the end 145 of the catch 141. The corresponding lock-out portion 106*a* and end 145 help prevent inappropriate connections from being made. Different sizes and/or shapes for the lock-out portion and the end of the catch may be used for different types of connectors to act as a lock-out mechanism. As shown in FIG. 1, the lock-out portion 106*a* may also serve as an inspection opening or window to allow a person to visually confirm that the pawls 121 have snapped into engagement with the catch 141. The catch 141 cannot thereafter by removed from the housing 101 unless both pawls 121 are rotated to respective "releasing" orientations.

As a person uses his/her thumb and forefinger to urge respective force receiving portions of the pawls 121 inward toward the housing 101 and further inside the cavity, the latching portions of the pawls 121 rotate outward away from one another and release the catch 141. The catch 141 may then be slid upward along the slot 106 and the end 145 may be withdrawn from the housing 101 from the lock-out portion 106*a*.

The connector 200 includes a housing 201 and a catch 241 as shown in FIGS. 20–24. With reference to FIGS. 25–28, the housing 201 includes a first outer plate 202 and a second outer plate 203, which are preferably made identical to one another for purposes of manufacturing efficiency. Therefore, for ease of reference, only the first outer plate 202 will be described herein in detail with regard to FIGS. 29–32.

The first outer plate 202 is preferably a rectangular shaped plate made of steel having a first raised portion 216 and a second raised portion 217. The first raised portion 216 extends longitudinally from one side to the other side of the plate 202, and the second raised portion 217 extends from the bottom to proximate the middle of the plate 202. When the plates 202 and 203 are operatively connected with their backs facing one another, the raised portions 216 and 217 are in communication with one another and define a T-shaped cavity 210 from the bottom to the sides of the housing 201. The raised portions 216 of each plate define an opening 208, and the raised portions 217 of each plate define an opening 205.

The first outer plate 202 includes a slot 206 proximate the junction of the raised portions 216 and 217. The slot 206 is preferably generally triangular shaped and is bottom of the slot 206 is defined by an engaging edge 206*a*. The first outer plate 202 also includes a slot 207 proximate the top of the raised portion 216 that is configured and arranged to receive the shoulder straps of the safety harness as is known in the art.

The first outer plate 202 also includes four apertures 212 and two apertures 212*a*. Two apertures 212 are positioned at the top of the housing 201, one on each side of the top of the slot 207. Two apertures 212*a* are positioned proximate the middle of the housing 101, one on each side of the bottom of the slot 206. The remaining two apertures 212 are positioned at the bottom of the housing 201, one on each side of the raised portion 217. The apertures 212 are configured and arranged to receive rivets 213, which are used to secure the first and second outer plates 202 and 203 together. The apertures 212*a* are configured and arranged to receive rivets 213*a*, which are used to secure the first and second outer plates 202 and 203 together and interact with springs 231.

The first outer plate 202 also includes two apertures 214, one on each side of the slot 206, configured and arranged to engage pawls 221. Pawls 221 are preferably made of steel and sized to be thinner than the width of the cavity 210 between the plates 202 and 203. With reference to FIGS. 33–37, in particular FIG. 34, the pawls 221 are preferably identical and rotated 180 degrees about a central axis A. Each pawl 221 includes a body 222, a first raised member 223, and a second raised member 224 including a slot 225. The body 222 is preferably L-shaped having a first leg 222*a* and a second leg 222*b*. The raised members 223 and 224 extend outward proximate the junction of the legs 222*a* and 222*b* forming the L-shape of the body 222. The first raised member 223 extends outward from the top of the pawl 221, and the second raised member 224 extends outward from the bottom of the pawl 221. The raised members 223 and 224 are configured and arranged to fit within the apertures 214 of the housing 201 and when assembled between the plates 202 and 203, are pivotable within the apertures 214.

With reference to FIGS. 38–40, the springs 231 each include a first end 232 and a second end 233. The springs 231 are generally S-shaped with the first end 232 at the top of the "S" and the second end 233 extending into the center of the bottom of the "S". The first end 232 forms an opening 232*a* through which the rivet 213*a* extends, and the second end 233 fits within the slot 225 of the pawl 221. Alternatively, a single compression spring connected between the pawls 221 as is known in the art may be used. The springs 231 interconnect the housing 201 and the pawls 221 thereby biasing the pawls 221. As a result, the pawls 221 are pivotally mounted between the first and second outer plates 202 and 203. The pawls 221 have respective latching portions that are biased toward one another by respective springs 231. This inward pivoting of the pawls 221 is limited by contact between the pawls 221 and respective rivets 213*a*. The pawls 221 also have respective force receiving portions that project away from one another and outward beyond the perimeter of the outer plates 202 and 203. These force receiving portions or "wings" define bearing surfaces that face away from the catch 141 and in divergent fashion relative to one another.

Each pawl 221 is pivotable about a pivot point, the aperture 214, between a first position and a second position. The pawls 221 and the cavity 210 define a first configuration when the pawls 221 are in the first position, and the pawls 221 and the cavity 210 define a second position when the pawls are in the second position. In the first position, the latching portions of the pawls 221 are pivoted outward away from one another and the force receiving portions of the pawls 221 are pivoted inward toward one another. The latching portions of the pawls 221 are pivoted outward to create a larger opening within the cavity 210 proximate the slot 206 thereby defining the first configuration, which is configured and arranged to receive the end 245 of the catch 241 and to allow for rotation of the catch 241 within the cavity 210 and the slot 206. In the second position, the latching portions of the pawls 221 are pivoted inward toward one another and the force receiving portions of the pawls 221 are pivoted outward away from one another. The latching portions of the pawls 221 are pivoted inward to create a smaller opening within the cavity proximate the slot 206 thereby defining the second configuration, which is configured and arranged to engage the end 245 of the catch 241 between the slot 206 and the pawls 221 and prevent rotation of the end 245 therebetween thereby locking the catch 241. In other words, the first configuration allows the catch 241 to be inserted into the cavity 210 proximate the slot 206 and rotated therein, and the second configuration does not allow the catch 241 to be rotated within the cavity 210 proximate the slot 206.

With reference to FIGS. 41–44, the catch 241 is preferably a key-like member including a strap engaging end 242 and a lead end 245. The strap engaging end 242 includes a slot 243 through which the strap of a lanyard may be inserted and operatively connected to the catch 241 as is well known in the art. An intermediate member 244 interconnects the strap engaging end 242 and the end 245 and must be more narrow than the opening 205 of the housing 201. The end 245 is preferably a triangular shaped member extending outward from the intermediate member 244 perpendicular to the strap engaging end 242 and includes recessed edges 246 proximate the intermediate member 244. The end 245 may be any suitable shape as long as it is capable of being inserted into the slot 206 of the housing 201.

In operation, the housing 201 has a "receiving" end defined by the opening 205 that is sized and configured to receive the lead end 245 and the intermediate member 244 of the catch 241. More specifically, the lead end 245 of the catch 241 may be described as generally triangular shaped, with recessed edges or shoulders 246 on opposite sides of the intermediate member 244. As the end 245 is inserted into the opening 205 and into the cavity 210, the end 245 pushes the second legs 222*b* outward (and the first legs 222*a* inward). When proximate the slot 206, the catch 241 is rotated within the cavity 210 approximately 90 degrees so that the end 245 is perpendicular to the surface of the housing 201. Upon rotation of the catch 241, the pawls 221 snap back toward one another thereby locking the end 245 between the pawls 221 and the slot 206 of the housing 201. The end 245 extends out of the slot 206, and the engaging edges 206*a* of the housing 201 fit within the recessed edges 246 of the catch 241. The pawls 221 act as locking members locking the end 245 between the pawls 221 and the slot 206 of the housing 201, and the end 245 may not be rotated therein. Should a fall occur, the engaging edge 206*a* of the slot 206 acts as a supporting member for the recessed edges 246 of the end 245 and the end 245 acts as an engaging member engaging the supporting member and applying force thereto.

Figure 20:
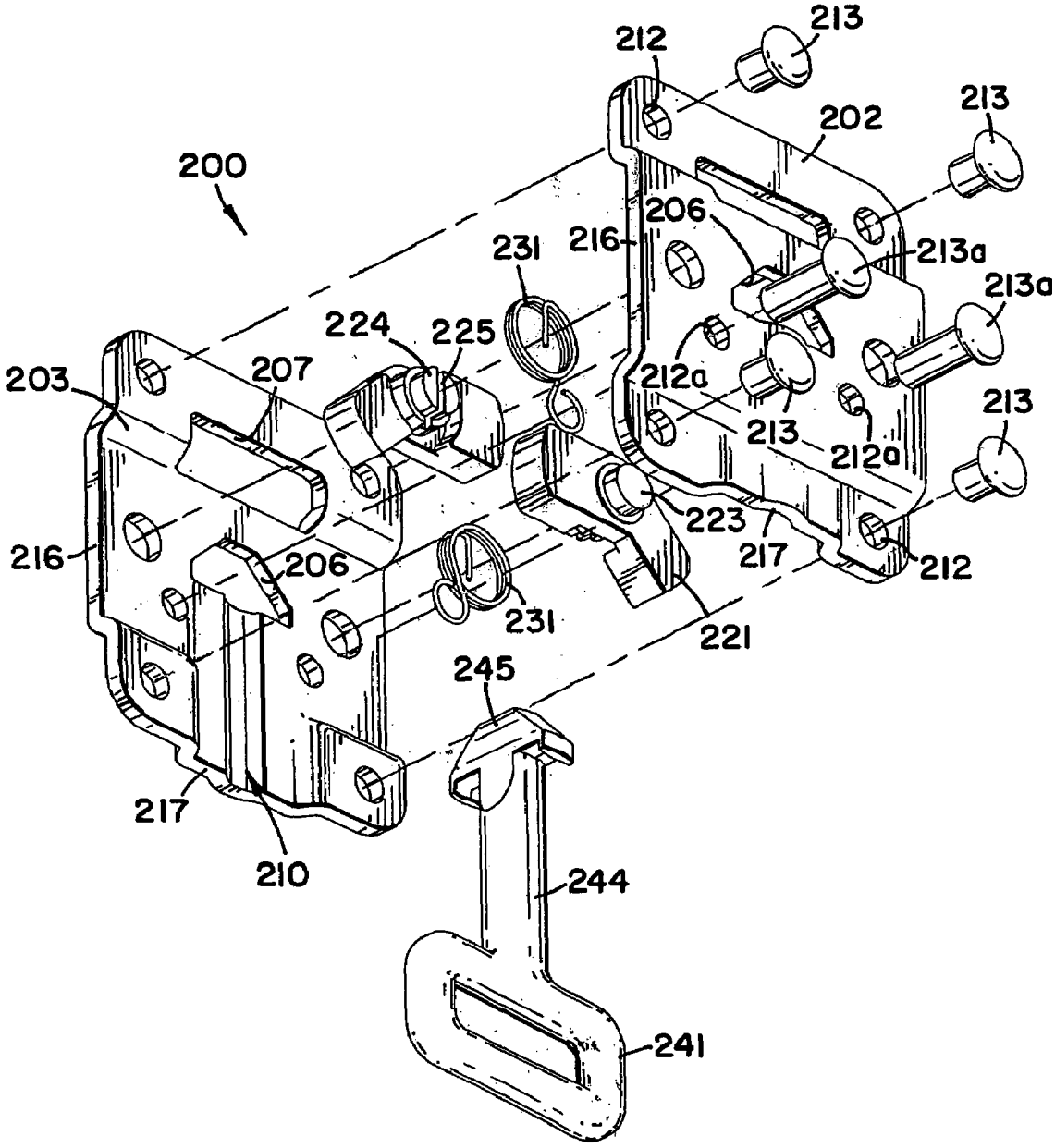
FIG. 20 is a front exploded perspective view of another embodiment connector constructed according to the principles of the present invention.
Figure 25:
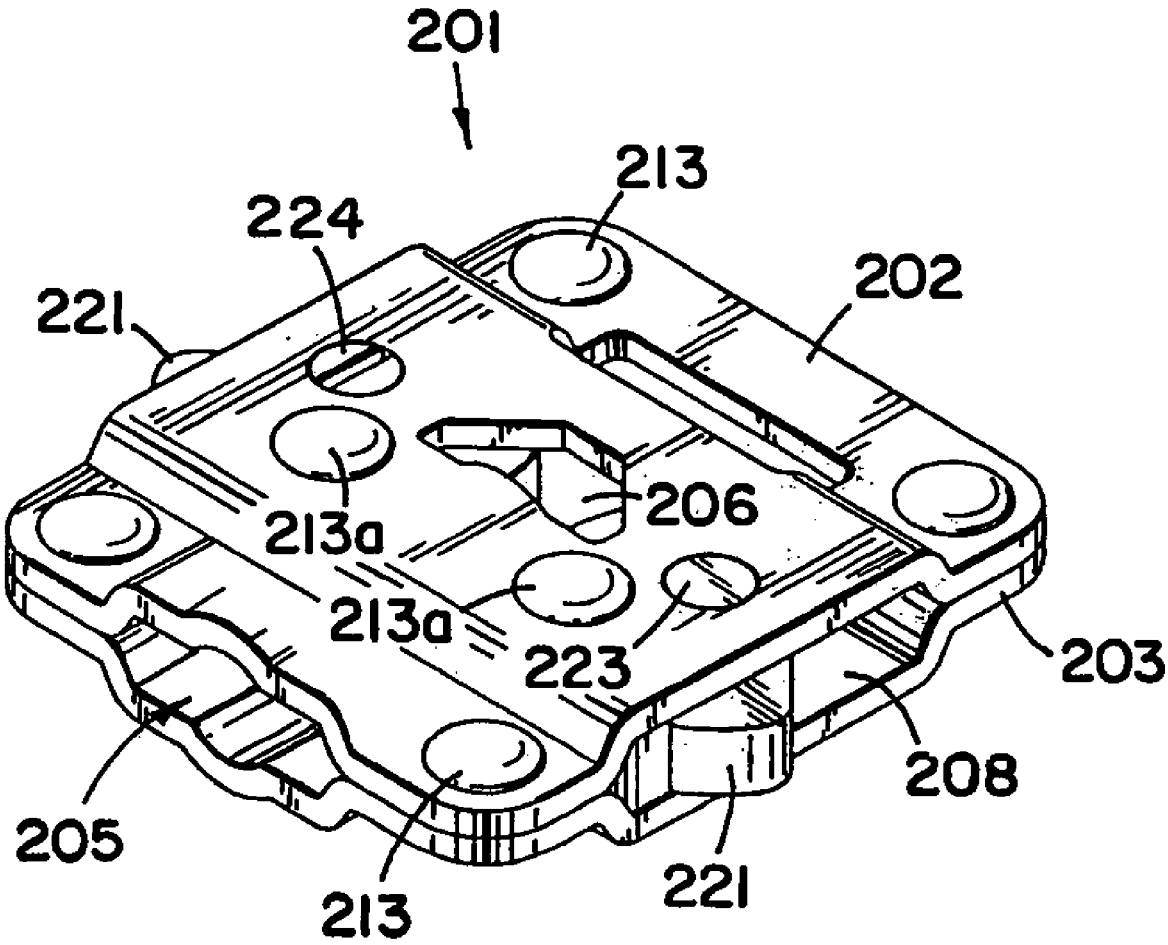
FIG. 25 is a front perspective view of a housing of the connector shown in FIG. 20.
Figure 27:
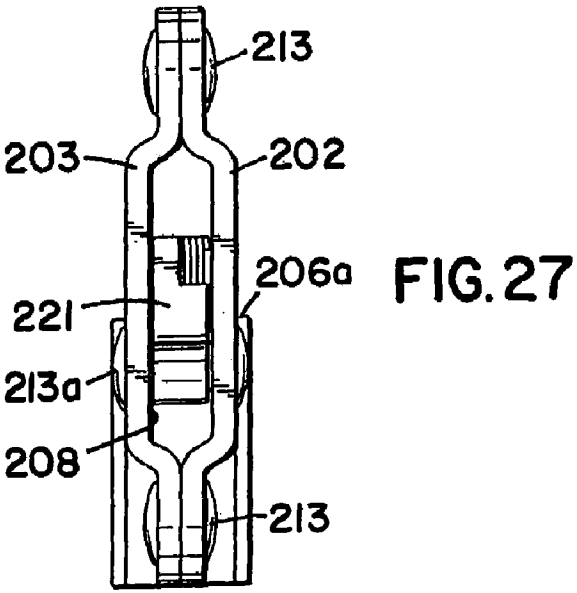
FIG. 27 is a right side view of the housing shown in FIG. 26.
Figure 26:
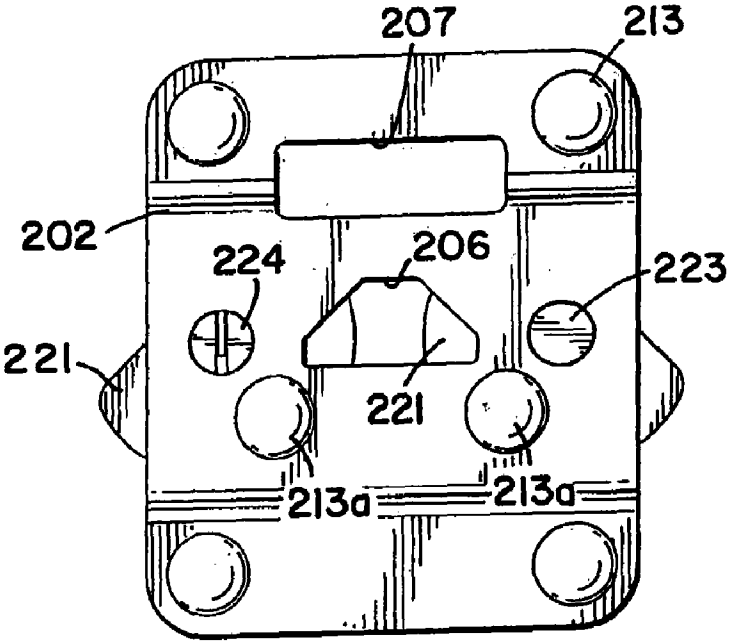
FIG. 26 is a front view of the housing shown in FIG. 25.
Figure 28:
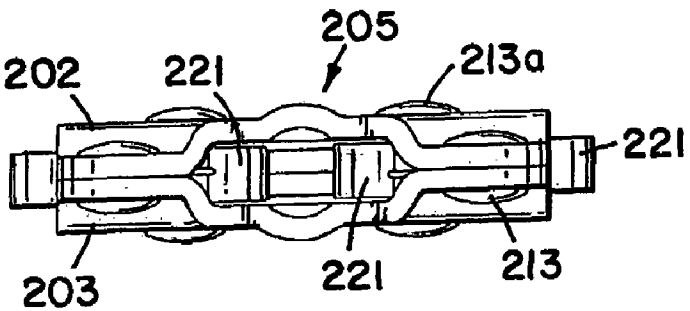
FIG. 28 is a bottom view of the housing shown in FIG. 26.
Figure 33:
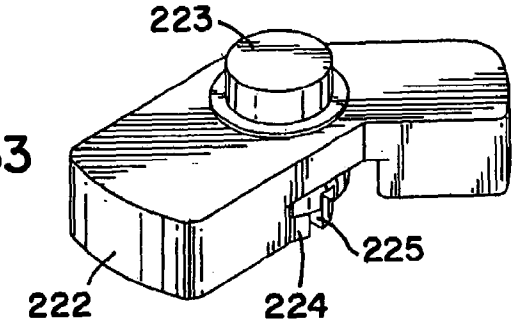
FIG. 33 is a front perspective view of a pawl of the connector shown in FIG. 20.
Figure 36:
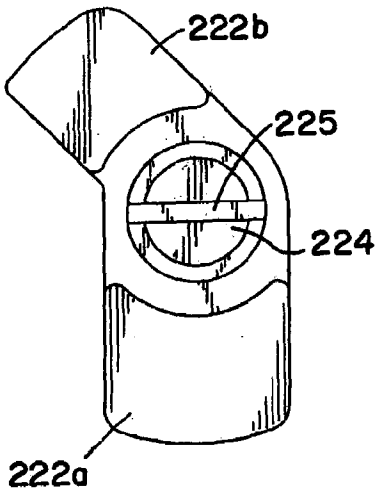
FIG. 36 is a back view of the pawl shown in FIG. 34.
Figure 35:
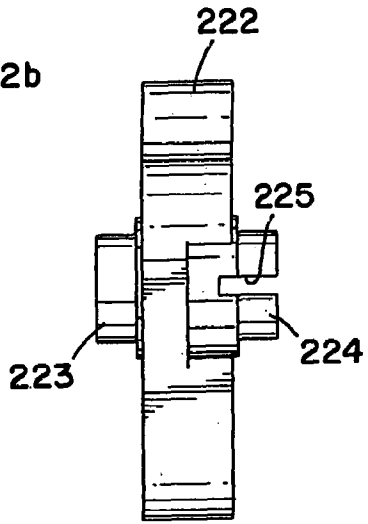
FIG. 35 is a right side view of the pawl shown in FIG. 34.
Figure 34:
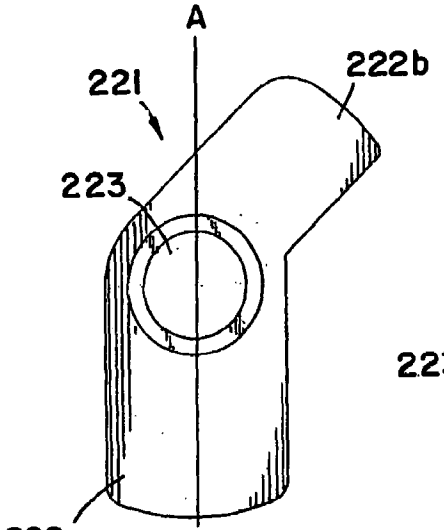
FIG. 34 is a front view of the pawl shown in FIG. 33.
Figure 37:
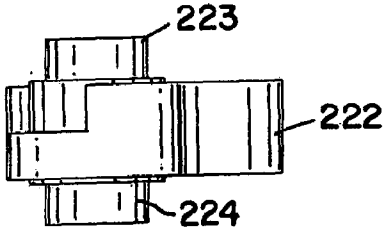
FIG. 37 is a top view of the pawl shown in FIG. 34.
Figure 41:
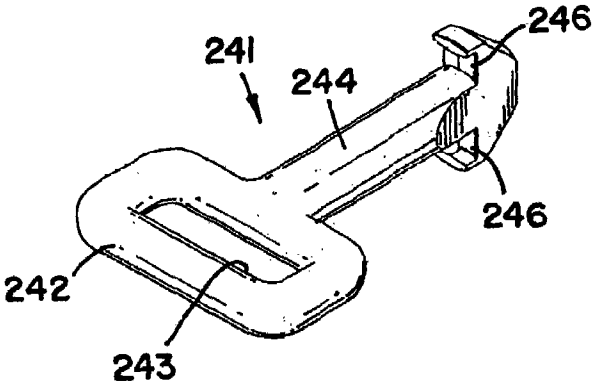
FIG. 41 is a front perspective view of a catch of the connector shown in FIG. 20.
Figure 44:
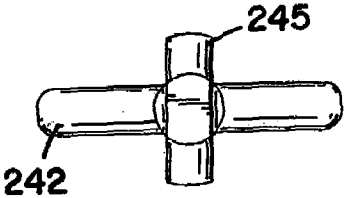
FIG. 44 is a top view of the catch shown in FIG. 42.
Figure 42:
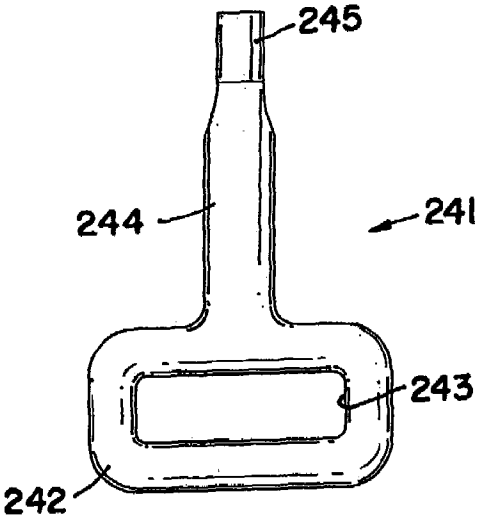
FIG. 42 is a front view of the catch shown in FIG. 41.
Figure 43:
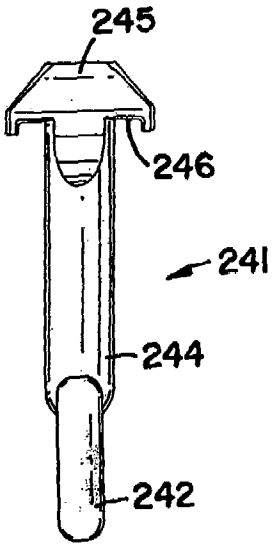
FIG. 43 is a left side view of the catch shown in FIG. 42.

The slot 206 may be any suitable shape as long as it corresponds with the shape of the end 245 of the catch 241 to help prevent inappropriate connections from being made. Different sizes and/or shapes for the slot and the end of the catch may be used for different types of connectors to act as a lock-out mechanism. As shown in FIG. 20, the slot 206 may also serve as an inspection opening or window to allow a person to visually confirm that the pawls 221 have snapped into engagement with the catch 241. The catch 241 cannot thereafter by removed from the housing 201 unless both pawls 221 are rotated to respective "releasing" orientations.

The connector 200 may be considered to be "double" locked because the pawls 221 must be released and the catch 241 must be rotated to disengage the catch 241 from the housing 201. The catch 241 must be rotated within the slot 206 of the housing 201 to withdraw the catch 241 from the cavity 210 of the housing 201, but the catch 241 cannot be rotated without first releasing the pawls 221. The spring loaded pawls 221 ensure that the catch 241 cannot be rotated within the slot 206 without first releasing the pawls 221.

As a person uses his/her thumb and forefinger to urge respective force receiving portions (legs 222*a*) of the pawls 221 toward the housing 201 and further inside the cavity, the latching portions (legs 222*b*) of the pawls 221 rotate away from one another and release the catch 241. The catch 241 may then be rotated 90 degrees and the end 245 may be withdrawn from the housing 201 from the cavity 210 and the opening 205.

Benefits of the present include, but are not limited to, a stronger and more reliable connector because the load exerted upon the catch is applied to the housing, not to the pawls. Therefore, should the pawls be released, the housing still carries the load of the catch and does not significantly decrease the reliability of the connector. Further, because there is an upward force on the housing and a downward force on the catch should a fall occur, the load from the fall reduces the likelihood of the housing disengaging the catch.

It is recognized that there are many possible applications in which the connector may be used. Some examples of ways in which the connector may be used are described in U.S. patent application Ser. No. 10/786,487 filed on Feb. 25, 2004 and entitled Simplification of Donning a Safety Harness and Connecting a Connecting Element to the Safety Harness, which is incorporated by reference herein.

Although the present invention has been described with reference to specific embodiments and particular applications, this disclosure will enable others to derive additional embodiments, improvements, and/or applications of the present invention. As a result, the scope of the present invention should be limited only to the extent of the following claims.

We claim:

1. A connector for use with a fall protection assembly, comprising:

a) a catch having an end with an engaging member;

b) a housing having a cavity and a supporting member; and c) at least one pawl pivotally mounted within the cavity having a first position and a second position, the cavity and the at least one pawl having a first configuration when the at least one pawl is in the first position, the cavity and the at least one pawl having a second configuration when the at least one pawl is in the second position, the first configuration being configured and arranged to receive the end of the catch, the second configuration being configured and arranged to engage the end of the catch thereby locking the catch, the end being engaged in the second configuration between the supporting member and the at least one pawl, the supporting member of the housing providing a surface upon which the engaging member exerts force when the catch and the housing are pulled in opposite directions should a fall occur.

2. The connector of claim 1, wherein the catch is rotatable within the housing to engage the supporting member, the at least one pawl securing the end into place between the supporting member and the at least one pawl.

3. The connector of claim 2, wherein the engaging member is a recessed edge of the end and the supporting member is an engaging edge of an opening in the housing, the engaging edge fitting within the recessed edge.

4. The connector of claim 1, wherein the engaging member is a recessed edge of the end and the supporting member is an engaging edge of an opening in the housing, the engaging edge fitting within the recessed edge.

5. The connector of claim 4, wherein the catch is rotatable within the housing to engage the supporting member, the at least one pawl securing the end into place between the supporting member and the at least one pawl.

6. The connector of claim 1, wherein the engaging member is a bar member and the supporting member is a bottom side of the housing, the at least one pawl securing the bar member into place between the bottom side of the housing and the at least one pawl.

7. The connector of claim 6, wherein the bar member is pivotable within the housing.

8. The connector of claim 1, wherein the at least one pawl is first and second pawls pivotally mounted within the cavity of the housing, the pawls having respective latching portions extending toward one another and force receiving portions projecting outward beyond a perimeter defined by the housing and extending away from one another in the second position.

9. The connector of claim 8, further comprising first and second springs interconnected between the housing and respective pawls in a manner that biases the latching portions of the pawls to pivot toward one another in the second position.

10. The connector of claim 1, further comprising an opening in the housing, the opening having a first shape and the end having a second shape, the first shape being configured and arranged to receive the second shape thereby providing a lock-out function for the housing and the catch.

11. A connector for use with a fall protection assembly, comprising:

a) a catch having an end with an engaging member;

b) a housing having a cavity and a supporting member; and c) first and second pawls pivotally mounted within the cavity of the housing and having a first position and a second position, the cavity and the pawls having a first configuration when the pawls are in the first position, the cavity and the pawls having a second configuration when the pawls are in the second position, the first configuration being configured and arranged to receive the end of the catch, the second configuration being configured and arranged to engage the end of the catch thereby locking the catch, the end being engaged in the second configuration between the supporting member and the pawls, the supporting member of the housing providing a surface upon which the engaging member exerts force when the catch and the housing are pulled in opposite directions should a fall occur.

12. The connector of claim 11, wherein the engaging member is a recessed edge of the end and the supporting member is an engaging edge of an opening in the housing, the engaging edge fitting within the recessed edge.

13. The connector of claim 11, wherein the engaging member is a bar member and the supporting member is a bottom side of the housing, the first and second pawls securing the bar member into place between the bottom side of the housing and the first and second pawls.

14. The connector of claim 11, wherein the pawls have respective latching portions extending toward one another and force receiving portions projecting outward beyond a perimeter defined by the housing and extending away from one another in the second position.

15. The connector of claim 14, further comprising first and second springs interconnected between the housing and respective pawls in a manner that biases the latching portions of the pawls to pivot toward one another in the second position.

16. The connector of claim 11, further comprising an opening in the housing, the opening having a first shape and the end having a second shape, the first shape being configured and arranged to receive the second shape thereby providing a lock-out function for the housing and the catch.

17. A connector for use with a fall protection assembly, comprising:

a) a housing having a cavity and a supporting member;

b) opposing first and second pawls pivotally mounted within the cavity of the housing, the pawls having respective latching portions extending toward one another and force receiving portions projecting outward beyond a perimeter defined by the housing and extending away from one another;

c) first and second springs interconnected between the housing and respective pawls in a manner that biases the latching portions of the pawls to pivot toward one another in a first position; and d) a catch having an end sized and configured for insertion between the pawls and engagement between the latching portions in such a manner that the force receiving portions must be moved in a direction toward the housing in a second position to release the end from between the pawls, the end being engaged in the second position between the supporting member and the pawls, the supporting member of the housing providing a surface upon which the end exerts force when the catch and the housing are pulled in opposite directions should a fall occur.

18. The connector of claim 17, wherein the catch is rotatable within the housing to engage the supporting member, the first and second pawls securing the end into place between the supporting member and the first and second pawls.

19. The connector of claim 17, wherein the engaging member is a recessed edge of the end and the supporting member is an engaging edge of an opening in the housing, the engaging edge fitting within the recessed edge.

20. The connector of claim 17, wherein the end is a bar member and the supporting member is a bottom side of the housing, the first and second pawls securing the bar member into place between the bottom side of the housing and the first and second pawls.

21. The connector of claim 20, wherein the bar member is pivotable within the housing.

22. The connector of claim 17, further comprising an opening in the housing, the opening having a first shape and the end having a second shape, the first shape being configured and arranged to receive the second shape thereby providing a lock-out function for the housing and the catch.

23. A connector for use with a fall protection assembly, comprising:

a) a catch having an end with an engaging member and a second end with a strap receiving opening;

b) a housing having a cavity, a supporting member, and a second strap receiving opening opposite the second end of the catch; and c) a at least one pawl pivotally mounted within the cavity having a first position and a second position, the cavity and the at least one pawl having a first configuration when the at least one pawl is in the first position, the cavity and the at least one pawl having a second configuration when the at least one pawl is in the second position, the first configuration being configured and arranged to receive the end of the catch, the second configuration being configured and arranged to engage the end of the catch thereby locking the catch, the end being engaged in the second configuration between the supporting member and the at least one pawl, the supporting member of the housing providing a surface upon which the engaging member exerts force when the second end of the catch and the housing proximate the second strap receiving opening are pulled in opposite directions should a fall occur.

24. The connector of claim 23, wherein the catch is rotatable within the housing to engage the supporting member, the at least one pawl securing the end into place between the supporting member and the at least one pawl.

25. The connector of claim 24, wherein the engaging member is a recessed edge of the end and the supporting member is an engaging edge of an opening in the housing, the engaging edge fitting within the recessed edge.

26. The connector of claim 23, wherein the engaging member is a bar member and the supporting member is a bottom side of the housing, the at least one pawl securing the bar member into place between the bottom side of the housing and the at least one pawl, the bar member being pivotable within the housing.

27. The connector of claim 23, wherein the at least one pawl is first and second pawls pivotally mounted within the cavity of the housing, the pawls having respective latching portions extending toward one another and force receiving portions projecting outward beyond a perimeter defined by the housing and extending away from one another in the second position, first and second springs interconnected between the housing and respective pawls in a manner that biases the latching portions of the pawls to pivot toward one another in the second position.

28. The connector of claim 23, further comprising an opening in the housing, the opening having a first shape and the end having a second shape, the first shape being configured and arranged to receive the second shape thereby providing a lock-out function for the housing and the catch.

* * * * *

UNITED STATES PATENT AND TRADEMARK OFFICE

CERTIFICATE OF CORRECTION

PATENT NO. : 7,114,225 B2
APPLICATION NO. : 10/935479
DATED : October 3, 2006
INVENTOR(S) : Casebolt et al.

It is certified that error appears in the above-identified patent and that said Letters Patent is hereby corrected as shown below:

Title page, [56] References Cited, OTHER PUBLICATIONS, line 2: "Sep. 2001" should read --Sep. 2004--

Signed and Sealed this

Eighth Day of July, 2008

JON W. DUDAS
*Director of the United States Patent and Trademark Office*